US008857305B1

(12) United States Patent
Tseng

(10) Patent No.: US 8,857,305 B1
(45) Date of Patent: Oct. 14, 2014

(54) ROPE PROJECTION DEVICE

(71) Applicant: STARJET Technologies Co., Ltd, Jintan (CN)

(72) Inventor: Jui-Fu Tseng, Yilan (TW)

(73) Assignee: STARJET Technologies Co., Ltd, Jintan (CN)

( * ) Notice: Subject to any disclaimer, the term of this patent is extended or adjusted under 35 U.S.C. 154(b) by 0 days.

(21) Appl. No.: 14/064,138

(22) Filed: Oct. 26, 2013

(51) Int. Cl.
*F41B 11/80* (2013.01)
*F42B 12/68* (2006.01)
*F41B 11/62* (2013.01)

(52) U.S. Cl.
CPC ..... *F41B 11/80* (2013.01); *F41B 11/62* (2013.01); *F42B 12/68* (2013.01)
USPC ..... 89/1.34; 124/71

(58) Field of Classification Search
USPC ..... 89/1.34; 42/1.09, 1.16; 124/71, 57–59
See application file for complete search history.

(56) References Cited

U.S. PATENT DOCUMENTS

| | | | | |
|---|---|---|---|---|
| 2,964,031 | A * | 12/1960 | Dotson | 124/57 |
| 3,889,652 | A * | 6/1975 | Curtis | 124/41.1 |
| 5,909,000 | A * | 6/1999 | Rakov | 89/7 |
| 6,244,261 | B1 * | 6/2001 | West, Jr. | 124/60 |
| 6,615,815 | B1 * | 9/2003 | Liang | 124/71 |
| 7,412,975 | B2 * | 8/2008 | Dillon, Jr. | 124/71 |
| 8,079,355 | B1 * | 12/2011 | Chung et al. | 124/71 |
| 2006/0054152 | A1 * | 3/2006 | Ambrico | 124/71 |

* cited by examiner

*Primary Examiner* — Reginald Tillman, Jr.

(57) ABSTRACT

A rope projection device for capturing an object is provided with a head assembly including an open central chamber and two open inclined cylinders spaced from both sides of the central chamber respectively; a capturing rope including a rope member in the central chamber, and two end weights in the inclined cylinders respectively; and a projection assembly including a housing including a recess having a first through hole, and a cap on the recess and having a second through hole; a sleeve in the housing; a diaphragm on a front end of the sleeve; an air canister in the sleeve; and a mechanism including a spring biased cylindrical member in the sleeve, a receptacle on the cylindrical member, a spring biased sliding member projecting out of the receptacle into a third through hole on the sleeve to be under the first through hole, and a rear sharp member.

1 Claim, 7 Drawing Sheets

ROPE PROJECTION DEVICE

BACKGROUND OF THE INVENTION

1. Field of the Invention

The invention relates to ropes and more particularly to a rope projection device.

2. Description of Related Art

A conventional lasso projection device or gun comprising a barrel having a discharge end and an operator end, sliding means slidably communicating with the barrel along a longitudinal axis of the barrel, front holding means for reversibly holding a lasso mounted on the sliding means, activating means for forcibly sliding the sliding means along the longitudinal axis of the barrel from a first position distal to the discharge end of the barrel to a second position proximal to the discharge end of the barrel, an arm having a pivot on one end and a rear lasso holding means for reversibly holding a lasso adjacent to the other end, the arm pivotally mounted about the pivot on the barrel such that the rear lasso holding means moves in an arc with one end of the arc being towards the operator end of the barrel and the other end of the arc being toward the discharge end of the barrel, lasso means for lassoing a target, the lasso means including a lasso having a loop encircling the front and the rear lasso holding means when the sliding means is in the first position and the rear lasso holding means is at the end of the arc toward an operator end of the barrel, such that when the sliding means slides from the first position towards the discharge end of the barrel, the motion of the sliding means is transferred to the lasso by the front lasso holding means via the loop of the lasso and the loop also pulls the rear lasso holding means through the arc and as the rear lasso holding means approaches the end of the arc toward the discharge end of the barrel and the sliding means approaches and stops in the second position, and the lasso is discharged from the discharge end of the barrel towards a target.

Notwithstanding the conventional lasso projection device, the invention is neither taught nor rendered obvious thereby.

SUMMARY OF THE INVENTION

It is therefore one object of the invention to provide a rope projection device comprising a head assembly comprising an open central chamber and two open inclined cylinders spaced from both sides of the central chamber respectively; a capturing rope comprising a rope member disposed in the central chamber, and two weights disposed at both ends of the rope member respectively, the weights being disposed in the inclined cylinders respectively; and a projection assembly comprising a housing including a recess having a first through hole, a cap disposed on the recess and having a second through hole aligned with the first through hole, and a ring shaped adapter releasably secured to the housing; a cylindrical sleeve disposed in the housing and releasably secured to the head assembly; a diaphragm mounted on a front end of the sleeve; an air canister disposed in the sleeve and contacting a rear end of the housing; and a mechanism including a spring biased cylindrical member anchored in the sleeve, a receptacle formed on the cylindrical member, a spring biased sliding member projecting out of the receptacle into a third through hole on a circumferential surface of the sleeve to be directly below the first through hole, and a sharp member formed at a rear end of the cylindrical member, the sharp member facing and spaced from a front end of the air canister; wherein a pushing down of the sliding member causes the sliding member to clear the third though hole, pushes the sharp member rearward to open the air canister by piercing, pressurized air released from the air canister pushes the mechanism back to its original, inoperative position, the pressurized air travels forward to be stopped by the diaphragm with air pressure being further increased, the diaphragm will be broken after the air pressure increase exceeds a predetermined pressure, and the pressurized air further travels to the inclined cylinders to propel the weights, thereby projecting the capturing rope out of the central cylinder and the inclined cylinders.

The above and other objects, features and advantages of the invention will become apparent from the following detailed description taken with the accompanying drawings.

DETAILED DESCRIPTION OF THE INVENTION

Figure 1:
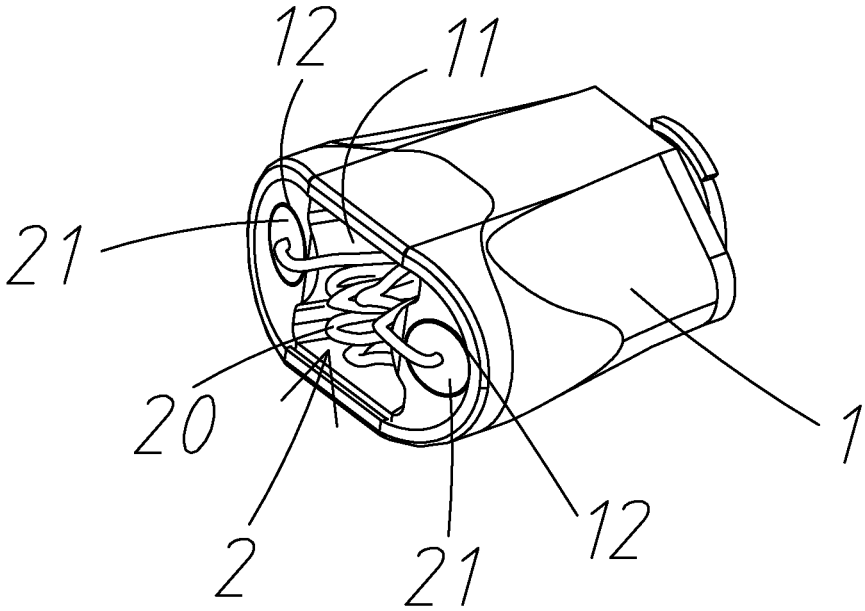
FIG. 1 is a perspective view of a head assembly of a rope projection device according to the invention.
Figure 2:
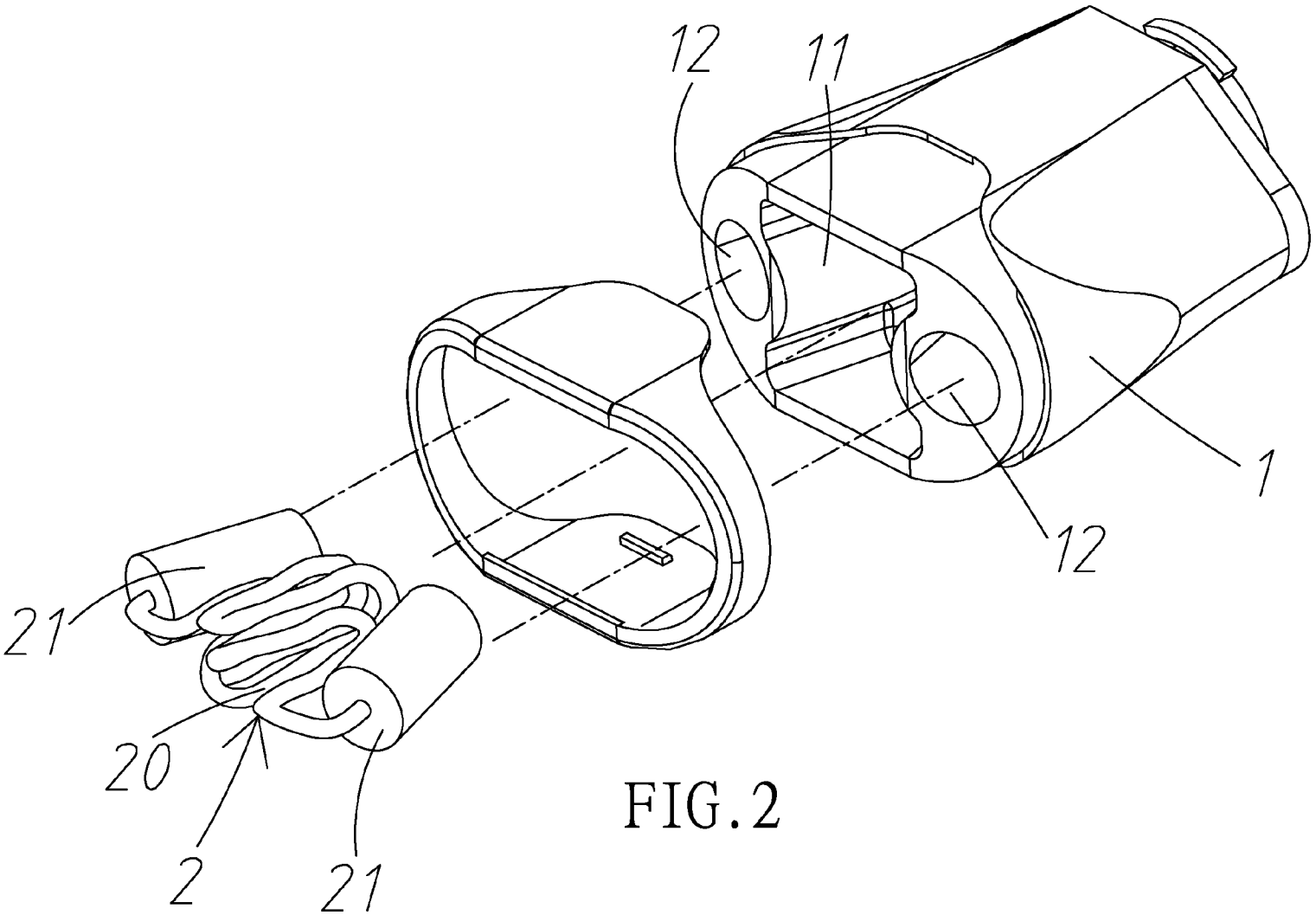
FIG. 2 is an exploded view of the head assembly.
Figure 3:
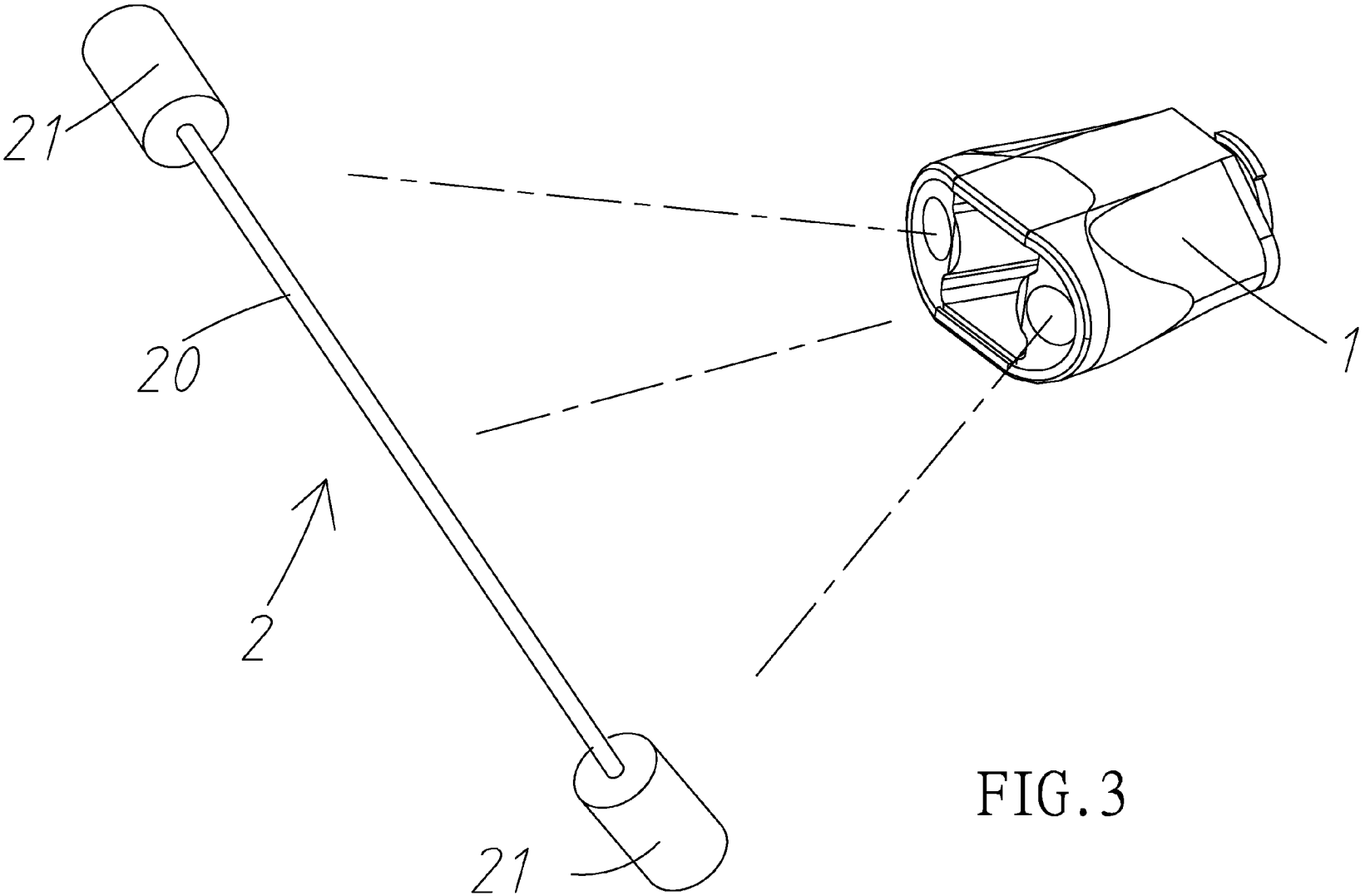
FIG. 3 is a perspective view of the head assembly with the rope being projected.
Figure 4:
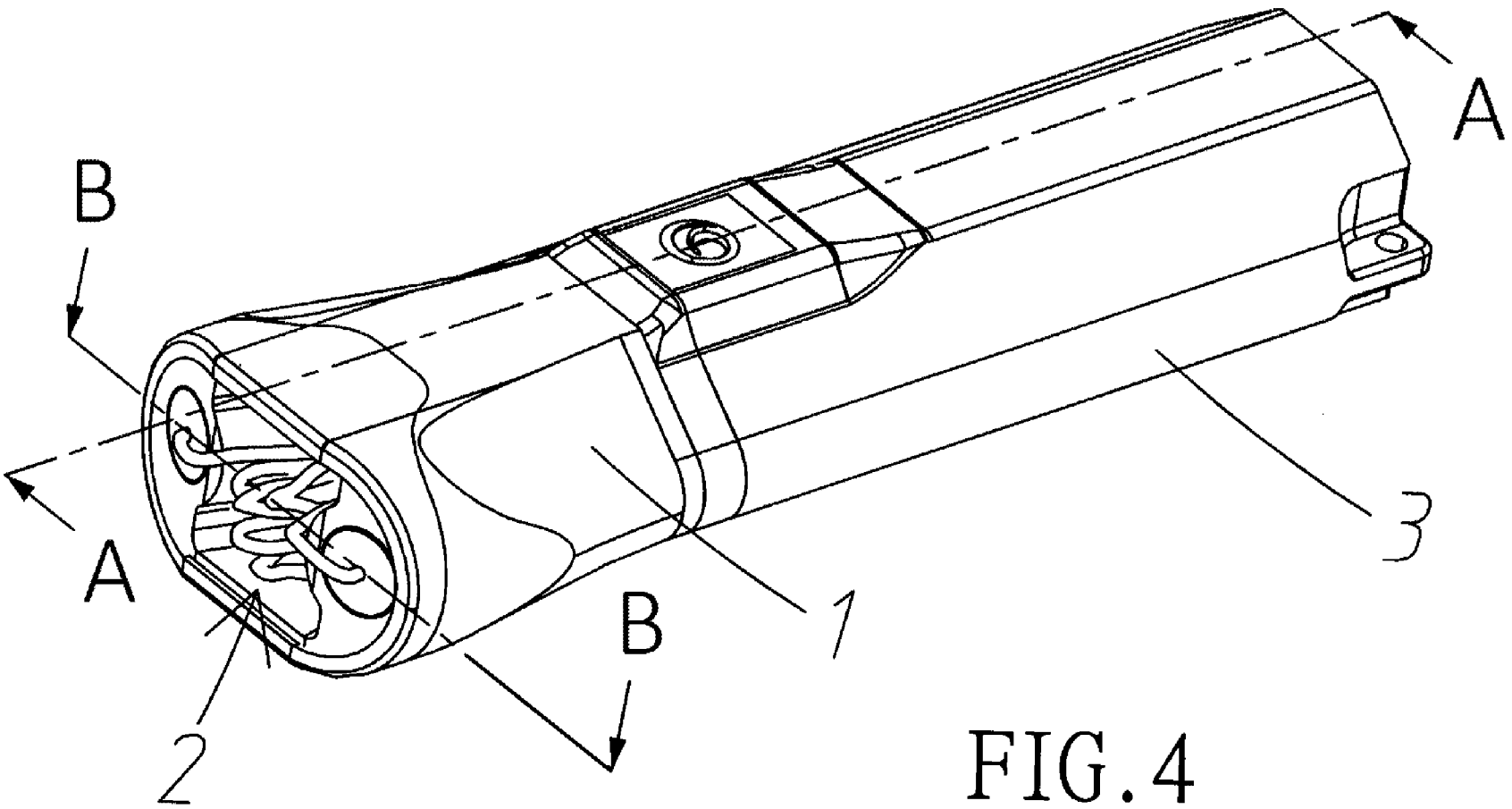
FIG. 4 is a perspective view of the rope projection device.
Figure 5:
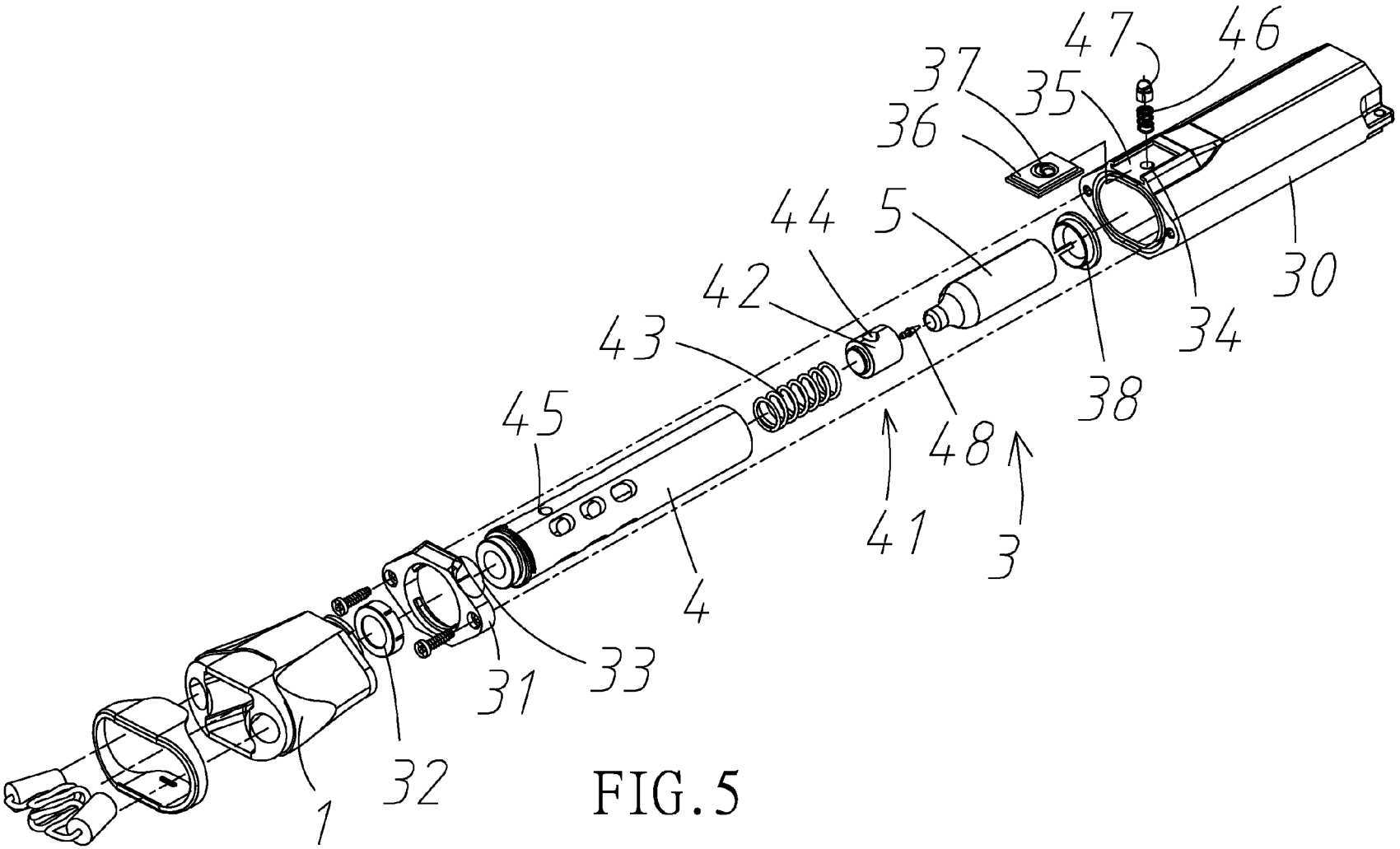
FIG. 5 is an exploded view of the rope projection device.
Figure 6:
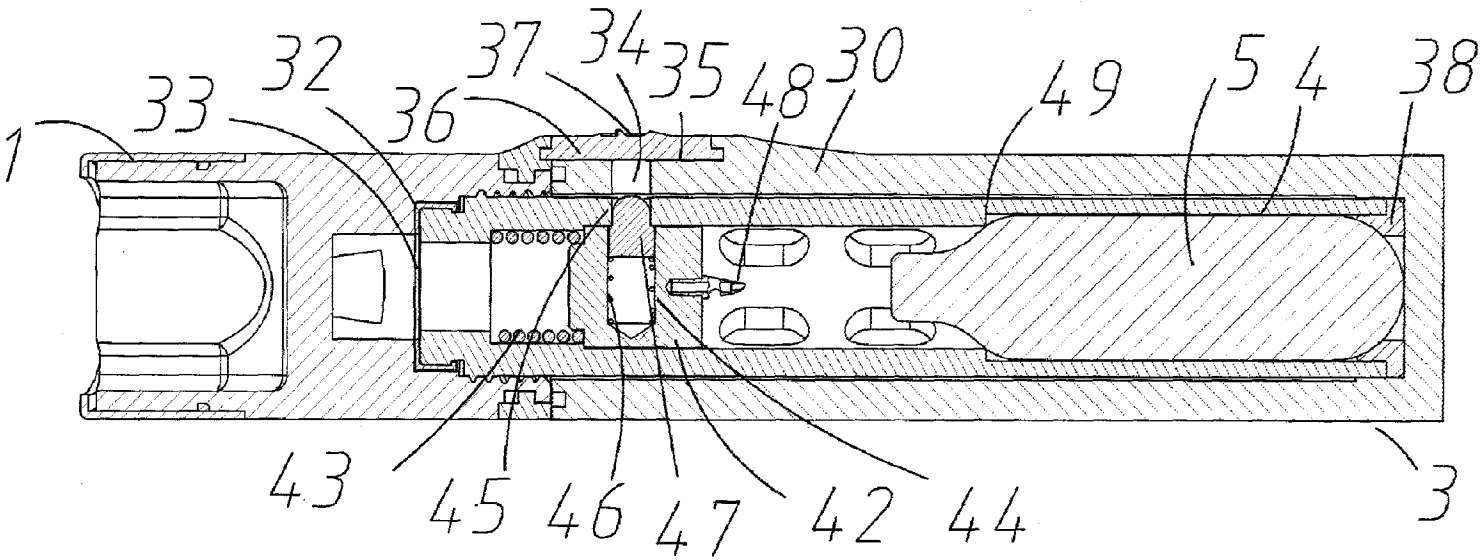
FIG. 6 is a sectional view taken along line A-A of FIG. 4.
Figure 7:
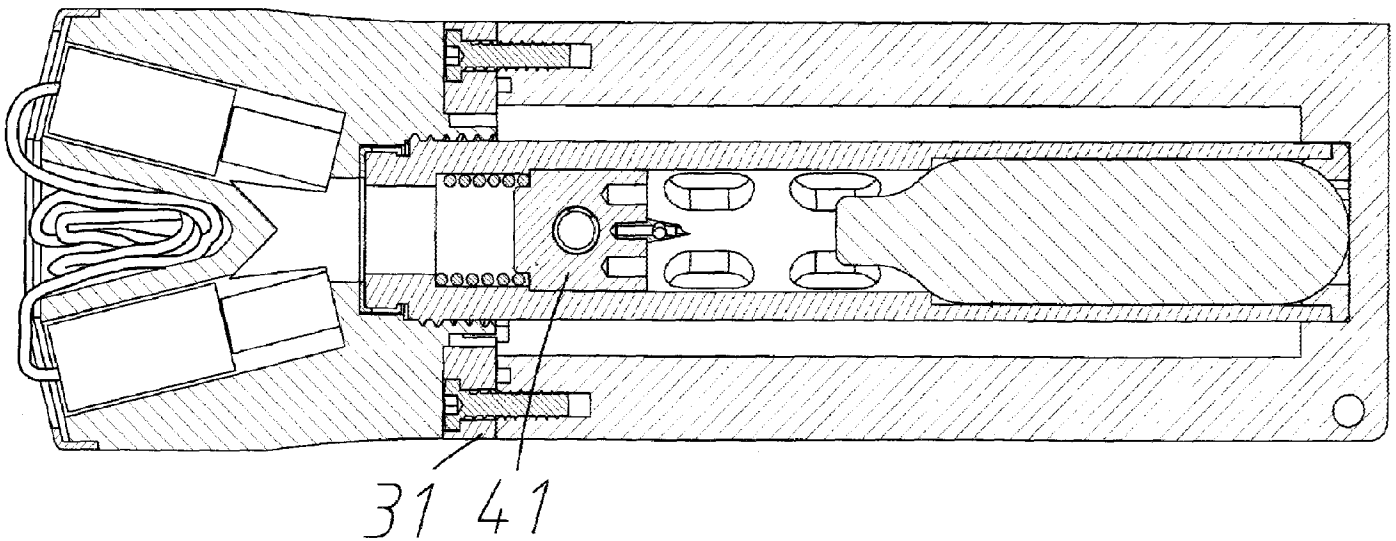
FIG. 7 is a sectional view taken along line B-B of FIG. 4.
Figure 8:
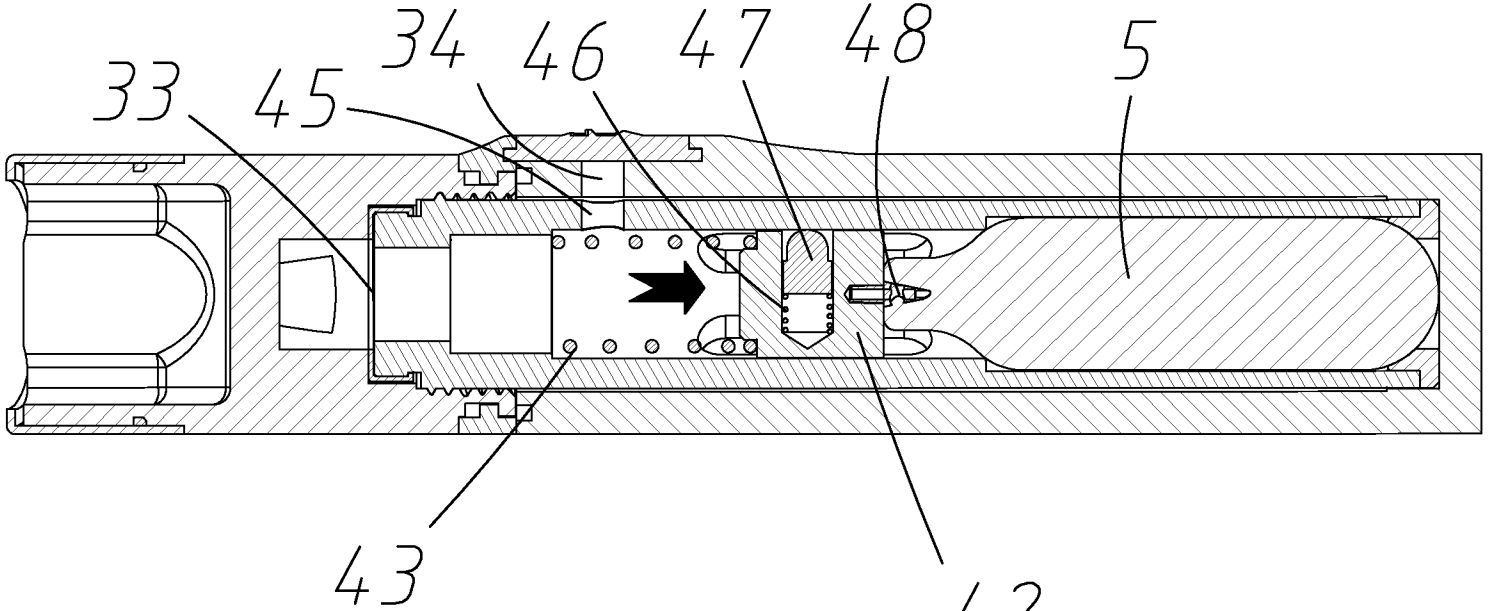
FIG. 8 is a view similar to FIG. 6 showing the air canister being open prior to projecting the rope.

Referring to FIGS. 1 to 8, a rope projection device in accordance with the invention comprises the following components as discussed in detail below.

A head assembly 1 is mounted to a front end of a projection assembly 3 and includes an open central chamber 11, and two open inclined cylinders 12 spaced from both sides of the central chamber 11 respectively. A capturing rope 2 includes a rope member 20 disposed in the central chamber 11 and two weights 21 formed at both ends of the rope member 20 and disposed in the inclined cylinders 12 respectively. The inclined cylinders 12 have its rear end communicating with the projection assembly 3.

Preferably, each of the inclined cylinders 12 is at an angle of 20 to 40-degree with respect to a lengthwise central line passing the central chamber 11. More preferably, each of the inclined cylinders 12 is at an angle of 25 to 35-degree with respect to the lengthwise central line passing the central chamber 11. Most preferably, each of the inclined cylinders 12 is at an angle of 27 to 30-degree with respect to the lengthwise central line passing the central chamber 11.

The projection assembly 3 includes a housing 30 having a blind rear end and a front opening with a ring shaped adapter 31 secured thereto by threaded fasteners. The adapter 31 is releasably secure to a rear end of the head assembly 1 by snapping or the like. A cylindrical sleeve 4 is disposed in the housing 30 and has an open rear end and a front opening threadedly secured to the head assembly 1. The projection assembly 3 further includes a ring 32 for mounting a diaphragm 33 on the opening of the sleeve 4 by snapping onto the edge of the opening of the sleeve 4. The projection assembly 3 further includes a ring shaped seat 38 disposed at the blind end of the housing 30. A cylindrical air canister 5 is disposed in the sleeve 4 from an intermediate portion through a rear portion of the sleeve 4 to urge against the seat 38. Further, a shoulder 49 on an inner surface of the sleeve 4 urges against a front transition portion of the air canister 5 for anchoring the air canister 5. A mechanism 41 includes a cylindrical member 42, a torsion spring 43 having a rear end put on a front neck of the cylindrical member 42 and a front end urging against a narrow, front inner surface of the sleeve 4 to be anchored, a receptacle 44 formed on the cylindrical member 42, a spring 46 disposed in the receptacle 44, a sliding member 47 disposed on a top end of the spring 46 and projecting out of the receptacle 44 into a through hole 45 on a circumferential surface of the sleeve 4, and a sharp member 48 formed at a center of a rear end of the cylindrical member 42. The sharp member 48 faces and is spaced from a front end of the air canister 5 in an inoperative position. On a front top portion of the housing 30, there is provided a rectangular recess 35 having a through hole 34 aligned with and proximal to the sliding member 47. A rectangular cap 36 is disposed on the recess 35 and has a through hole 37 aligned with the through hole 34.

Is use (see FIGS. 6 and 8), an operator may use a long, slender object to insert into the through holes 37, 34 to push down the sliding member 47 until the top of the sliding member 47 clears the though hole 34 (i.e., reaching the point of no return). And in turn, the compressed spring 43 releases its elastic force to quickly push the mechanism 41 rearward. And in turn, the concealed opening of the air canister 5 is pierced to open by the sharp member 48. The pressurized air in the air canister 5 thus pushes the mechanism 41 back to its original, inoperative position with the spring 43 being compressed and the sliding member 47 being pushed into the receptacle 44 and the through hole 45. Also, the pressurized air travels forward to be stopped by the diaphragm 33 with air pressure being further increased. The diaphragm 33 will be broken after the air pressure increase exceeds a predetermined pressure. It is noted that the predetermined pressure depends upon thickness and material of the diaphragm 33. The pressurized air further travels to the inclined cylinders 12 to propel the weights 21. As a result, the capturing rope 2 is projected out of the central cylinder 11 and the inclined cylinders 12. The capturing rope 2 can rotate about a point of contacting an object (e.g., an animal or individual) after hitting the object. As such, the weights 21 loop around the object one or more times. As a result, the object is captured or snarled. The maximum range of projection is about 10 meters.

While the invention has been described in terms of preferred embodiments, those skilled in the art will recognize that the invention can be practiced with modifications within the spirit and scope of the appended claims.

What is claimed is:

1. A rope projection device comprising:

a head assembly comprising a central chamber having an open front end, and two inclined cylinders spaced from both sides of the central chamber respectively, each of the inclined cylinders having two ends open;

a capturing rope comprising a rope member disposed in the central chamber, and two weights disposed at both ends of the rope member respectively, the weights being disposed in the inclined cylinders respectively; and a projection assembly comprising a housing including a recess having a first through hole, a cap disposed on the recess and having a second through hole aligned with the first through hole, and a ring shaped adapter releasably secured to the housing; a cylindrical sleeve disposed in the housing and releasably secured to the head assembly, the cylindrical sleeve including a third through hole formed on a circumferential surface; a diaphragm mounted on a front end of the sleeve; an air canister disposed in the sleeve and contacting a rear end of the housing; and a mechanism including a spring biased cylindrical member anchored in the sleeve, a receptacle formed on the cylindrical member, a spring biased sliding member projecting out of the receptacle into the third through hole below the first through hole, and a sharp member disposed at a rear end of the cylindrical member, the sharp member facing and spaced from a front end of the air canister;

wherein a pressing of the sliding member causes the spring biased sliding member to clear the third though hole, the sharp member is pushed rearward by the spring biased cylindrical member to open the air canister by piercing, pressurized air released from the air canister pushes the mechanism including the spring biased sliding member back to a position prior to the pressing, the pressurized air travels forward to be stopped by the diaphragm with air pressure being further increased, the diaphragm will be broken after the air pressure increase exceeds a predetermined pressure, and the pressurized air further travels to the inclined cylinders to propel the weights, thereby projecting the capturing rope out of the central cylinder and the inclined cylinders.

* * * * *